US006253480B1

(12) United States Patent
Florez

(10) Patent No.: US 6,253,480 B1
(45) Date of Patent: Jul. 3, 2001

(54) PERSONALIZED SAFETY DEVICE FOR A HAND HELD WEAPON

(76) Inventor: Carlos Florez, 16401 NW. 84th Ave., Miami Lakes, FL (US) 33016

( * ) Notice: Subject to any disclaimer, the term of this patent is extended or adjusted under 35 U.S.C. 154(b) by 0 days.

(21) Appl. No.: 09/276,107

(22) Filed: Mar. 25, 1999

(51) Int. Cl.[7] ..... F41A 17/06
(52) U.S. Cl. ..... 42/70.11; 42/70.6; 42/70.7
(58) Field of Search ..... 42/66, 84, 70.01, 42/70.06, 70.07, 70.11

(56) References Cited

U.S. PATENT DOCUMENTS 4,467,545 * 8/1984 Shaw, Jr. ..... 42/70 R
5,392,552 * 2/1995 McCarthy et al. ..... 42/70.07
5,417,000 * 5/1995 Chen ..... 42/70.06
5,487,234 * 1/1996 Dragon ..... 42/70.07
5,502,915 * 4/1996 Mendelsohn et al. ..... 42/70.11
5,619,817 * 4/1997 Jones ..... 42/70.01
5,621,996 * 4/1997 Mowl, Jr. ..... 42/70.07
5,638,627 * 6/1997 Klein et al. ..... 42/70.07
5,647,158 * 7/1997 Eskelinen et al. ..... 42/70.07
5,713,149 * 2/1998 Cady et al. ..... 42/70.06

* cited by examiner

*Primary Examiner*—Michael J. Carone
*Assistant Examiner*—John Richardson

(57) ABSTRACT

A personalized safety device for a hand held weapon for preventing unauthorized use of a hand held weapon having a trigger. The personalized safety device for a hand held weapon includes a housing which is coupled to a weapon such that the housing is positioned in front of the handgrip and trigger of the weapon. A pair of elongate guard plates outwardly extend from a pair of elongate slots in the back of the housing. A motor is disposed in the housing for extending and the retracting the guard plates from the housing. A computer is provided for controlling the retraction and extension of the guard plates by the motor. A scanner is mounted to the handgrip of the weapon and is in communication with the computer. The scanner obtains an image of the fingerprints and handprint of the user grasping the handgrip. If the scanned image matches data stored in the computer corresponding to the fingerprints and handprint of an authorized user, the computer activates the motor to retract the guard plates.

8 Claims, 3 Drawing Sheets

PERSONALIZED SAFETY DEVICE FOR A HAND HELD WEAPON

BACKGROUND OF THE INVENTION

1. Field of the Invention

The present invention relates to personalized safety devices for hand held weapons and more particularly pertains to a new personalized safety device for a hand held weapon for preventing unauthorized use of a hand held weapon having a trigger.

2. Description of the Prior Art

The use of personalized safety devices for hand held weapons is known in the prior art. More specifically, personalized safety devices for hand held weapons heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,603,179; U.S. Pat. No. 4,467,545; U.S. Pat. No. 4,970,819; U.S. Pat. No. 5,062,232; U.S. Pat. No. 5,151,633; and U.S. Pat. No. Des. 375,342 which are all incorporated by reference herein.

While these devices fulfill their respective, particular objectives and requirements, the aforementioned patents do not disclose a new personalized safety device for a hand held weapon. The inventive device includes a housing which is coupled to a weapon such that the housing is positioned in front of the handgrip and trigger of the weapon. A pair of elongate guard plates outwardly extend from a pair of elongate slots in the back of the housing. A motor is disposed in the housing for extending and the retracting the guard plates from the housing. A computer is provided for controlling the retraction and extension of the guard plates by the motor. A scanner is mounted to the handgrip of the weapon and is in communication with the computer. The scanner obtains an image of the fingerprints and handprint of the user grasping the handgrip. If the scanned image matches data stored in the computer corresponding to the fingerprints and handprint of an authorized user, the computer activates the motor to retract the guard plates.

In these respects, the personalized safety device for a hand held weapon according to the present invention substantially departs from the conventional concepts and designs of the prior art, and in so doing provides an apparatus primarily developed for the purpose of preventing unauthorized use of a hand held weapon having a trigger.

SUMMARY OF THE INVENTION

In view of the foregoing disadvantages inherent in the known types of personalized safety devices for hand held weapons now present in the prior art, the present invention provides a new personalized safety device for a hand held weapon construction wherein the same can be utilized for preventing unauthorized use of a hand held weapon having a trigger.

The general purpose of the present invention, which will be described subsequently in greater detail, is to provide a new personalized safety device for a hand held weapon apparatus and method which has many of the advantages of the personalized safety devices for hand held weapons mentioned heretofore and many novel features that result in a new personalized safety device for a hand held weapon which is not anticipated, rendered obvious, suggested, or even implied by any of the prior art personalized safety devices for hand held weapons, either alone or in any combination thereof.

To attain this, the present invention generally comprises a housing which is coupled to a weapon such that the housing is positioned in front of the handgrip and trigger of the weapon. A pair of elongate guard plates outwardly extend from a pair of elongate slots in the back of the housing. A motor is disposed in the housing for extending and the retracting the guard plates from the housing. A computer is provided for controlling the retraction and extension of the guard plates by the motor. A scanner is mounted to the handgrip of the weapon and is in communication with the computer. The scanner obtains an image of the fingerprints and handprint of the user grasping the handgrip. If the scanned image matches data stored in the computer corresponding to the fingerprints and handprint of an authorized user, the computer activates the motor to retract the guard plates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personalized safety device for a hand held weapon apparatus and method which has many of the advantages of the personalized safety devices for hand held weapons mentioned heretofore and many novel features that result in a new personalized safety device for a hand held weapon which is not anticipated, rendered obvious, suggested, or even implied by any of the prior art personalized safety devices for hand held weapons, either alone or in any combination thereof.

It is another object of the present invention to provide a new personalized safety device for a hand held weapon which may be easily and efficiently manufactured and marketed.

It is a further object of the present invention to provide a new personalized safety device for a hand held weapon which is of a durable and reliable construction.

An even further object of the present invention is to provide a new personalized safety device for a hand held weapon which is susceptible of a low cost of manufacture with regard to both materials and labor, and which accordingly is then susceptible of low prices of sale to the consuming public, thereby making such personalized safety device for a hand held weapon economically available to the buying public.

Still yet another object of the present invention is to provide a new personalized safety device for a hand held weapon which provides in the apparatuses and methods of the prior art some of the advantages thereof, while simultaneously overcoming some of the disadvantages normally associated therewith.

Still another object of the present invention is to provide a new personalized safety device for a hand held weapon for preventing unauthorized use of a hand held weapon having a trigger.

Yet another object of the present invention is to provide a new personalized safety device for a hand held weapon which includes a housing which is coupled to a weapon such that the housing is positioned in front of the handgrip and trigger of the weapon. A pair of elongate guard plates outwardly extend from a pair of elongate slots in the back of the housing. A motor is disposed in the housing for extending and the retracting the guard plates from the housing. A computer is provided for controlling the retraction and extension of the guard plates by the motor. A scanner is mounted to the handgrip of the weapon and is in communication with the computer. The scanner obtains an image of the fingerprints and handprint of the user grasping the handgrip. If the scanned image matches data stored in the computer corresponding to the fingerprints and handprint of an authorized user, the computer activates the motor to retract the guard plates.

Still yet another object of the present invention is to provide a new personalized safety device for a hand held weapon that may be used on any weapon having a trigger.

Even still another object of the present invention is to provide a new personalized safety device for a hand held weapon that may be made as an add on for pre-existing hand held weapons or integrally manufactured on new hand held weapons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
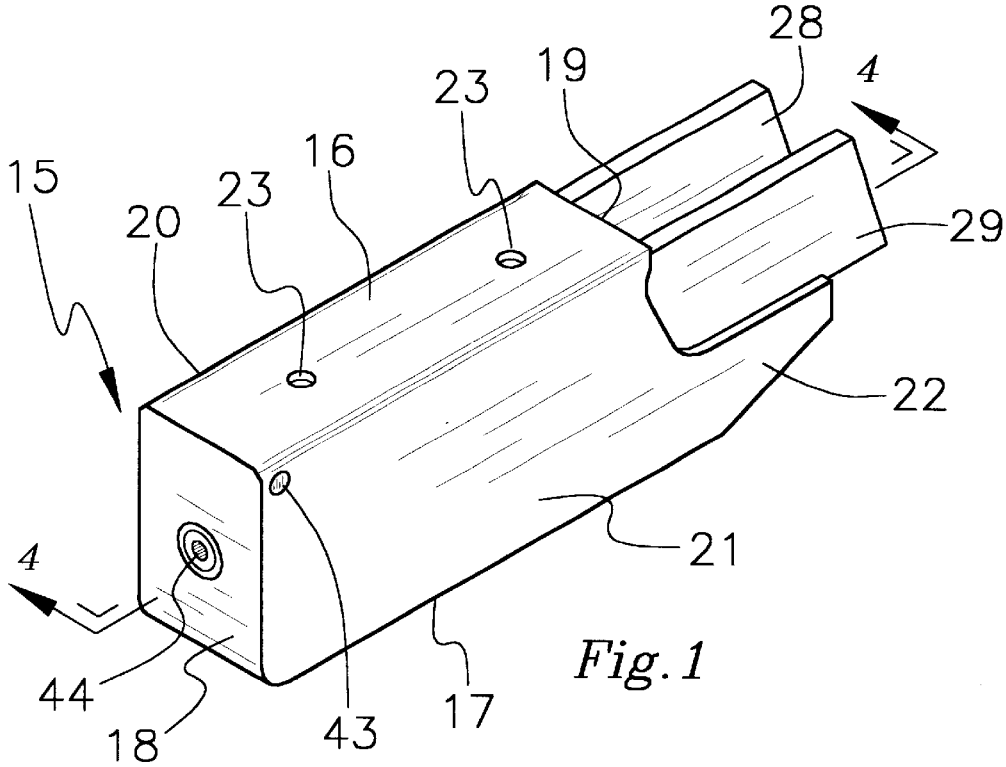
FIG. 1 is a schematic front perspective view of a new personalized safety device for a hand held weapon according to the present invention.

With reference now to the drawings, and in particular to FIGS. 1 through 9 thereof, a new personalized safety device for a hand held weapon embodying the principles and concepts of the present invention will be described.

As best illustrated in FIGS. 1 through 9, the personalized safety device for a hand held weapon generally comprises a housing which is coupled to a weapon such that the housing is positioned in front of the handgrip and trigger of the weapon. A pair of elongate guard plates outwardly extend from a pair of elongate slots in the back of the housing. A motor is disposed in the housing for extending and the retracting the guard plates from the housing. A computer is provided for controlling the retraction and extension of the guard plates by the motor. A scanner is mounted to the handgrip of the weapon and is in communication with the computer. The scanner obtains an image of the fingerprints and handprint of the user grasping the handgrip. If the scanned image matches data stored in the computer corresponding to the fingerprints and handprint of an authorized user, the computer activates the motor to retract the guard plates.

In use, the personalized safety device is designed for use on a weapon 10 having a handgrip 11, a trigger 12 forwardly located from the handgrip, and preferably a trigger guard 13 around the trigger. In an after-market embodiment, a lower forwards break 14 may have to be formed in the trigger guard to provide a passage through the trigger guard.

The system includes a housing 15 has a top 16, a bottom 17, a front 18, a back 19 and a pair of sides 20, 21. The housing has a rear portion 22 rearwardly extending from the back of the housing adjacent the bottom of the housing. The rear portion of the housing has an upper face lying in a plane between the top and bottom of the housing.

The top of the housing is coupled to the weapon such that the housing is positioned in front of the handgrip. In one preferred embodiment, the top of the housing may have a pair of mounting holes 23 for permitting extension of fasteners therethrough and into the weapon to couple the top of the housing to the weapon. The back of the housing is positioned adjacent the trigger guard of the weapon so that the rear portion of the housing is positioned adjacent the lower forwards break of the trigger guard. In an embodiment where the housing is integrally formed with the weapon, no lower forwards break is needed because the upper face of the rear portion forms a portion of the trigger guard spanning the location of the lower forwards break found in the after-market embodiment.

Figure 5:
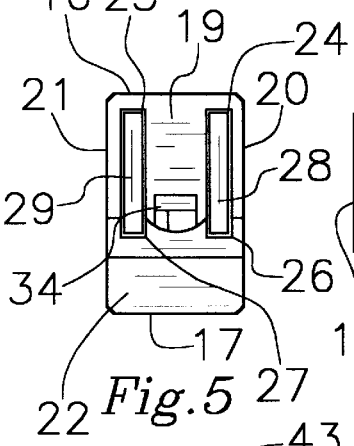
FIG. 5 is a schematic back view of the present invention as seen from the vantage of line 5—5 of FIG. 4.
Figure 6:
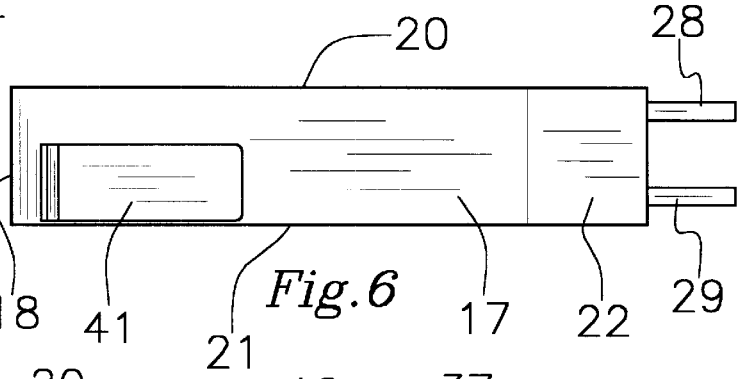
FIG. 6 is a schematic bottom view of the present invention.
Figure 9:
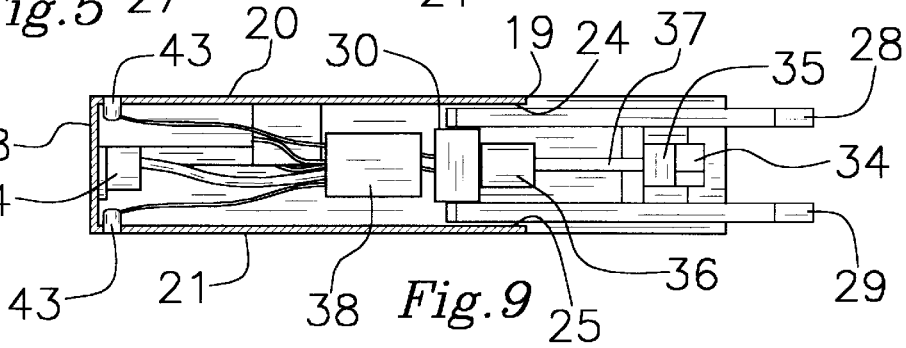
FIG. 9 is a schematic cross sectional view of the present invention taken from line 9—9 of FIG. 4.
Figure 7:
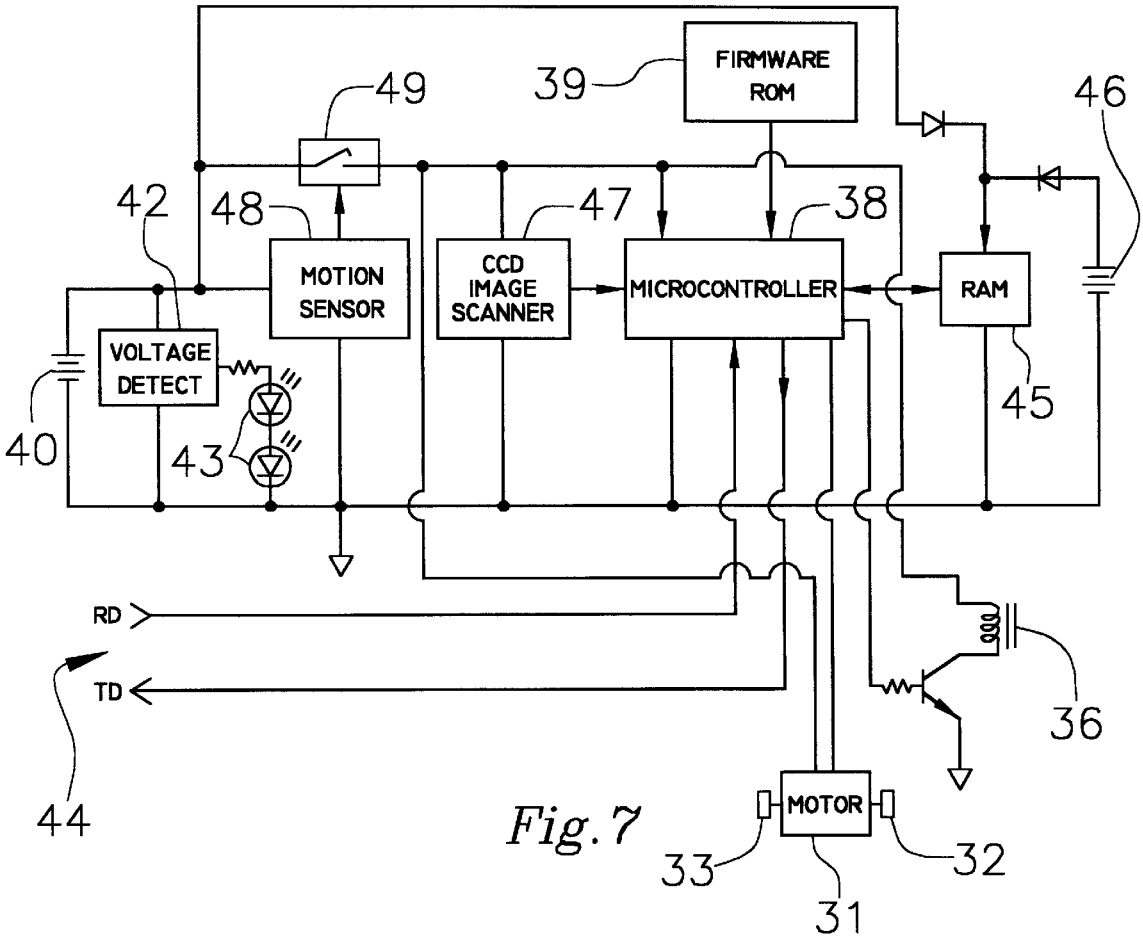
FIG. 7 is an electrical schematic of the present invention.
Figure 8:
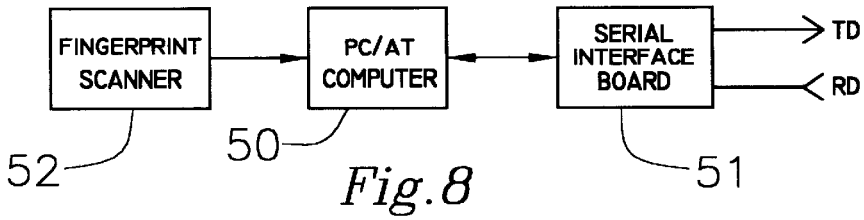
FIG. 8 is an electrical schematic of the external computer.

As best illustrated in FIG. 5, the back of the housing has a spaced apart pair of substantially parallel elongate slots 24, 25 therein. Preferably, the upper face of the rear portion of the housing has a spaced apart pair of substantially parallel elongate channels 26, 27 rearwardly extending from the back of the housing. A first of the elongate channels is positioned adjacent a first of the elongate slots of the back of the housing and a second of the elongate channels is positioned adjacent a second of the elongate slots of sad back of the housing.

Figure 2:
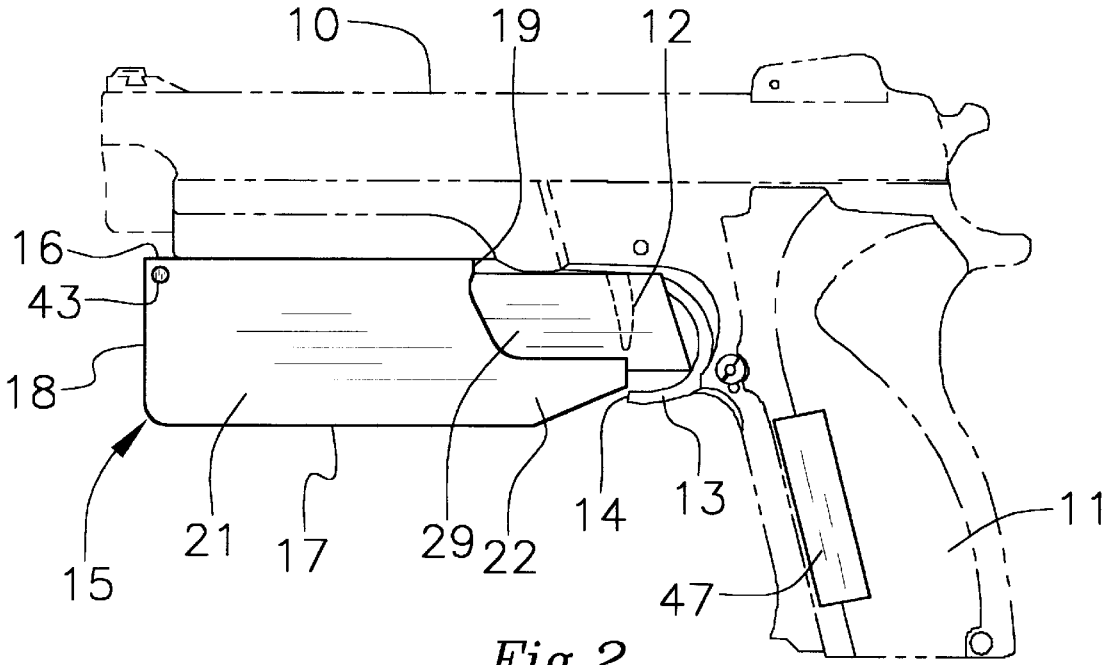
FIG. 2 is a schematic side view of the present invention on a hand held weapon with the guard plates in their extended position covering the trigger and trigger guard of the weapon.
Figure 3:
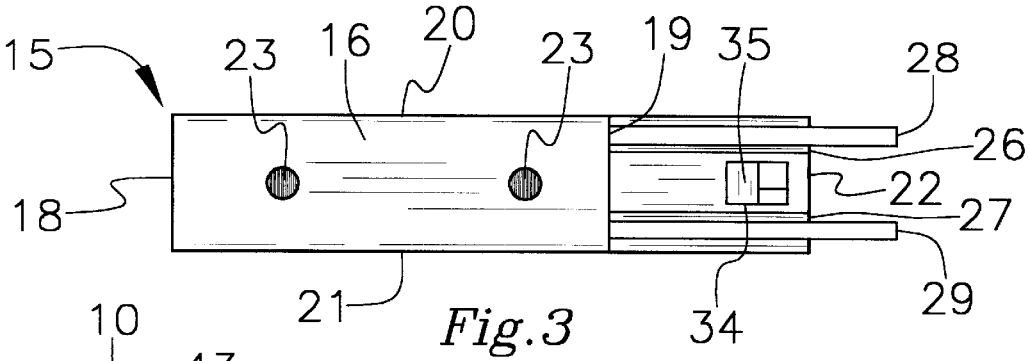
FIG. 3 is a schematic top view of the present invention.
Figure 4:
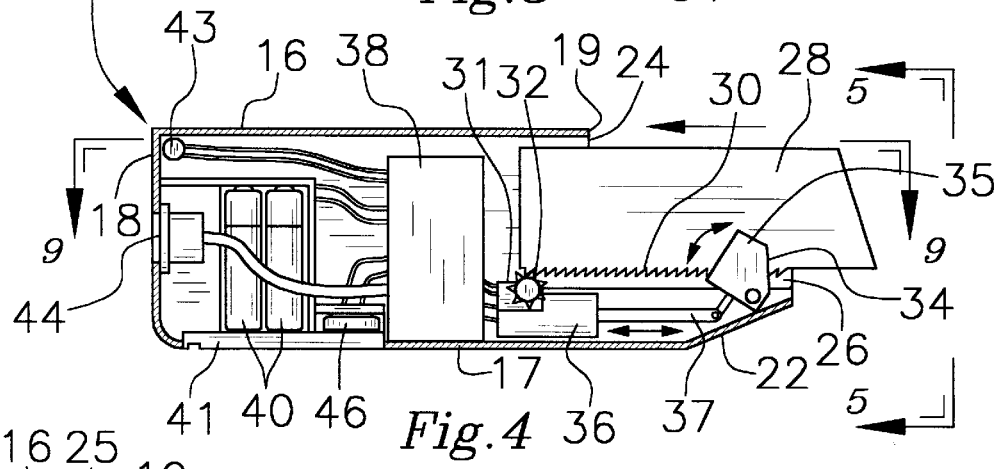
FIG. 4 is a schematic cross sectional view of the present invention taken from line 4—4 of FIG. 1.

A pair of elongate guard plates 28, 29 are also included with the first elongate channel receiving a first of the guard plates and the second elongate channel receiving a second of the guard plates. The first guard plate is slidably inserted into the first elongate slot and the second guard plate is slidably inserted into the second elongate slot. In use, the first and second guard plates are slidable in and out of the housing between extended and retracted positioned. As best illustrated in FIG. 2, the guard plates are rearwardly extended from the back of the housing to substantially cover sides of the trigger guard when the guard plates are positioned in the extended position to prevent a user's finger from is extendable through the trigger guard. Conversely, the guard plates are extended into the back of the housing to uncover sides of the trigger guard when the guard plates are positioned in the retracted position to permit a user's finger to be extendable through the trigger guard in front of the trigger.

Each of the guard plates has a toothed lower edge 31. A motor 31 is disposed in the housing and has a pair of rotatable toothed wheels 32, 33. One of the toothed wheels gearingly engages the toothed lower edge of the first guard plate and the other of the toothed wheels gearingly engages the toothed lower edge of the second guard plate. In use, rotation of the toothed wheels in a first direction by the motor thereby moves the guard plates towards the extended position. Similarly, rotation of the toothed wheels in a second direction opposite the first direction by the motor thereby moves the guard plates towards the retracted position.

Preferably, a trigger stop 34 is pivotally mounted in a recess in to the rear portion of the housing such that the trigger stop is positioned adjacent the trigger of the weapon. In use, the trigger stop is pivotable between raised and lower positions. The trigger stop has an upper portion 35 extending through the break in the trigger guard and behind the trigger to thereby prevent actuation of the trigger and thereby prohibit discharge of the weapon when the trigger stop is pivoted to the raised position. When the trigger stop is pivoted to the lowered position, the upper portion of the trigger stop is retracted into the rear portion of the housing to thereby permit actuation of the trigger to discharge the weapon.

A solenoid 36 disposed in the housing has a retractably extendable actuating rod 37 extending therefrom which is coupled to the trigger stop. In use, the extension of the actuating rod out of the solenoid by the solenoid pivots the trigger stop towards the raised position. Conversely, the retraction of the actuating rod into the solenoid by the solenoid pivots the trigger stop towards the lowered position.

A computer 38 (i.e., central processing unit) is provided in the housing and is in electrical communication with the motor and the solenoid. The computer has computer circuitry 39 for selectively controlling rotation of the toothed wheels in the first and second directions and controlling retraction and extension of the actuator rod in and out of the solenoid.

A first battery power source 40 is provided in the housing and in electrical communication with the computer, the motor, and the solenoid for providing power to the computer, the motor, and the solenoid. Preferably, the bottom of the housing has a removable access panel 41 for providing access to the first battery power source. Ideally, a voltage detector 42 is disposed in the housing and is electrically connected to the first battery power source for detecting voltage across the first battery source. The voltage detector has a pair of light sources 43 (preferably light emitting diodes) electrically connected thereto. One of the light sources is mounted on one of the sides of the housing and the other of the light sources is mounted to the other of the sides of the housing. In use, the voltage detector illuminates the light sources when the voltage detector detects a voltage across the first battery power source less than a predetermined voltage to provide a visual indicator to a user when the battery power is running low and needing to be recharged or replaced.

The front of the housing a communication port 44 in electrical communication with the computer. The communication port is designed for electrically connecting to an external computer 50 via an interface board 51 tor permitting input into the computer input data corresponding to an image of a particular user's fingerprints and handprints taken by an external scanner 52 connected to the external computer.

The computer has computer memory 45 electrically connected thereto for storing the input data. The computer preferably has a second battery power source 46 electrically connected to the computer memory for maintaining storage of the input data in the computer memory. The second battery power source is positioned adjacent the access panel to provide easy access to the second battery power source.

At least one scanner 47 is mounted to the handgrip of the weapon (preferably, a scanner is mounted to each side of the handgrip). The scanner is in electrical communication with the computer. In use, the scanner obtains an image of the fingerprints and handprints of a user grasping the handgrip and sends a corresponding digital signal to the computer corresponding to the obtained image. Preferably, the scanner has an optical scan surface large enough to offer a complete image of the user's fingerprint.

The computer than compares the corresponding signal received from the scanner with the input data. When the corresponding signal matches the input data (thereby indicating that an authorized user is grasping the handgrip), the computer activates the motor to rotate the toothed wheels in the second direction to move the guard panels to the retracted position and activates and the solenoid to retract the actuator rod to pivot the trigger stop to the lowered position. When an unauthorized user whose fingerprints and handprints are not stored in the computer member grasps the handgrip, the scanner sends a corresponding signal to the computer that does not match with the input data. Upon such an occurrence, the computer prevents retracting of the guard plates and lowering of the trigger stop.

When the authorized user releases their grasp on the handgrip, the scanner sends a release signal to computer. Upon receipt of the release signal to cover the trigger once the authorized user lets go of the weapon, the computer activates the motor to rotate the toothed wheels in the first direction to move the guard panels to the extended position and activates the solenoid to extend the actuator rod to pivot the trigger stop to the raised position.

A motion detector 48 (such as a type of mercury switch) for detecting motion is disposed in the housing for detecting when the housing and weapon are moved. The motion detector is electrically connected to the computer, the motor and the solenoid. The motion detector has an activation switch 49 electrically connected between the first battery power source and the computer, motor, and solenoid. In use, the motion detector activates (i.e., closes) the switch upon detection of motion to thereby provide energy to the computer, motor and solenoid from the first battery power source. The motion detector deactivates (i.e., opens) the switch upon the lack of detection of motion for a predetermined elapsed amount of time to thereby cut off energy to the computer, motor and solenoid from the first battery power source.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A safety system for a weapon, comprising:

a weapon having a handgrip, a trigger forwardly located from said handgrip;

a housing having a top, a bottom, a front, a back and a pair of sides;

said top of said housing being coupled to said weapon such that said housing is positioned in front of said handgrip;

said back of said housing having a spaced apart pair of substantially parallel elongate slots therein;

a pair of elongate guard plates, a first of said guard plates being slidably inserted into a first of said elongate slots a second of said guard plates being slidably inserted into a second of said elongate slots;

said first and second guard plates being slidable between extended and retracted positions;

wherein said guard plates are rearwardly extended from said back of said housing to substantially cover said trigger when said guard plates are positioned in said extended position to prevent a user's finger from being extendable in front of said trigger;

wherein said guard plates are extended into said back of said housing to uncover said trigger when said guard plates are positioned in said retracted position to permit a user's finger to be positioned in front of said trigger;

a motor for moving said guard plates between said extended and retracted positions;

a computer being provided in said housing and in electrical communication with said motor;

said housing including a communication port in electrical communication with said computer, said communication port being adapted for electrically connecting to an external computer for permitting input into said computer input data corresponding to an image of a particular user's fingerprints and handprints;

a scanner being mounted to said handgrip of said weapon and in electrical communication with said computer for obtaining an image of the fingerprints and handprints of a user grasping said handgrip and sending a corresponding signal to said computer corresponding to the obtained image;

said computer comparing said corresponding signal received from said scanner with said input data wherein said computer activating said motor to move said guard panels to said retracted position when said corresponding signal matches said input data;

a motion detector for detecting motion being disposed in said housing, motion detector being electrically connected to said computer, said motion detector having an activation switch electrically connected to said computer said motion detector activating said switch to activate said computer upon detection of motion of said housing by said motion detector.

2. The safety system of claim 1, wherein said housing has a rear portion rearwardly extending from said back of said housing adjacent said bottom of said housing, wherein said rear portion of said housing has a spaced apart pair of substantially parallel elongate channels rearwardly extending from said back of said housing, a first of said elongate channels being positioned adjacent said first elongate slot of said back of said housing and a second of said elongate channels being positioned adjacent said second elongate slot of sad back of said housing, said first elongate channel receiving said first guard plate, and said second elongate channel receiving said second guard plate.

3. The safety system of claim 1, wherein each of said guard plates has a toothed lower edge, wherein said motor has a pair of rotatable toothed wheels, one of said toothed wheels engaging said toothed lower edge of said first guard plate and the other of said toothed wheels engaging said toothed lower edge of said second guard plate, wherein rotation of said toothed wheels in a first direction by said motor thereby moves said guard plates towards said extended position, and wherein rotation of said toothed wheels in a second direction opposite said first direction by said motor thereby moves said guard plates towards said retracted position.

4. The safety system of claim 1, further comprising a trigger stop being pivotally mounted to said housing such that said trigger stop is positioned adjacent said trigger of said weapon, said trigger stop being pivotable between raised and lower positions, wherein said trigger stop has an upper portion extending behind said trigger to thereby prevent actuation of said trigger and thereby prohibit discharge of said weapon when said trigger stop is pivoted to said raised position, wherein said upper portion of said trigger stop is retracted into said rear portion of said housing to thereby permit actuation of said trigger to discharge said weapon when said trigger stop is pivoted to said lowered position.

5. The safety system of claim 4, further comprising a solenoid having a retractably extendable actuating rod extending therefrom, said actuating rod being coupled to said trigger stop, wherein said extension of said actuating rod out of said solenoid by said solenoid pivots said trigger stop towards said raised position, wherein said retraction of said actuating rod into said solenoid by said solenoid pivots said trigger stop towards said lowered position.

6. The safety system of claim 1, wherein said computer is in electrical communication with said solenoid for selectively controlling retraction and extension of said actuator rod in and out of said solenoid, wherein said computer activates said solenoid to retract said actuator rod to pivot said trigger stop to said lowered position when said corresponding signal matches said input data.

7. A safety system for a weapon, comprising:

a weapon having a handgrip, a trigger forwardly located from said handgrip, and a trigger guard around said trigger, said trigger guard having a lower forwards break providing a passage through said trigger guard;

a housing having a top, a bottom, a front, a back and a pair of sides;

said housing having a rear portion rearwardly extending from said back of said housing adjacent said bottom of said housing;

said rear portion of said housing having an upper face lying in a plane between said top and bottom of said housing;

said top of said housing being coupled to said weapon such that said housing is positioned in front of said handgrip, wherein said top of said housing has a pair of mounting holes for permitting extension of fasteners therethrough and into said weapon to couple said top of said housing to said weapon;

said back of said housing being positioned adjacent said trigger guard of said weapon, said rear portion of said housing being position adjacent said lower forwards break of said trigger guard;

said back of said housing having a spaced apart pair of substantially parallel elongate slots therein;

said upper face of said rear portion of said housing having a spaced apart pair of substantially parallel elongate channels rearwardly extending from said back of said housing;

a first of said elongate channels being positioned adjacent a first of said elongate slots of said back of said housing and a second of said elongate channels being positioned adjacent a second of said elongate slots of sad back of said housing;

a pair of elongate guard plates, said first elongate channel receiving a first of said guard plates, and said second elongate channel receiving a second of said guard plates;

said first guard plate being slidably inserted into said first elongate slot, said second guard plate being slidably inserted into said second elongate slot;

said first and second guard plates being slidable between extended and retracted positioned;

wherein said guard plates are rearwardly extended from said back of said housing to substantially cover said trigger guard when said guard plates are positioned in said extended position to prevent a user's finger from being extendable through said trigger guard;

wherein said guard plates are extended into said back of said housing to uncover said trigger guard when said guard plates are positioned in said retracted position to permit a user's finger to be extendable through said trigger guard in front of said trigger;

each of said guard plates having a toothed lower edge;

a motor being disposed in said housing and having a pair of rotatable toothed wheels, one of said toothed wheels engaging said toothed lower edge of said first guard plate and the other of said toothed wheels engaging said toothed lower edge of said second guard plate;

wherein rotation of said toothed wheels in a first direction by said motor thereby moves said guard plates towards said extended position, and wherein rotation of said toothed wheels in a second direction opposite said first direction by said motor thereby moves said guard plates towards said retracted position;

a trigger stop being pivotally mounted to said rear portion of said housing such that said trigger stop is positioned adjacent said trigger of said weapon;

said trigger stop being pivotable between raised and lower positions;

wherein said trigger stop has an upper portion extending through said break in said trigger guard and behind said trigger to thereby prevent actuation of said trigger and thereby prohibit discharge of said weapon when said trigger stop is pivoted to said raised position;

wherein said upper portion of said trigger stop is retracted into said rear portion of said housing to thereby permit actuation of said trigger to discharge said weapon when said trigger stop is pivoted to said lowered position;

a solenoid having a retractably extendable actuating rod extending therefrom, said actuating rod being coupled to said trigger stop;

wherein said extension of said actuating rod out of said solenoid by said solenoid pivots said trigger stop towards said raised position;

wherein said retraction of said actuating rod into said solenoid by said solenoid pivots said trigger stop towards said lowered position;

a computer being provided in said housing and in electrical communication with said motor and said solenoid for selectively controlling rotation of said toothed wheels in said first and second directions and controlling retraction and extension of said actuator rod in and out of said solenoid;

a first battery power source being provided in said housing and in electrical communication with said computer, said motor, and said solenoid;

said bottom of said housing having a removable access panel for providing access to said first battery power source;

a voltage detector being disposed in said housing and being electrically connected to said first battery power source for detecting voltage across said first battery source, said voltage detector having a pair of light sources electrically connected thereto, one of said light sources being mounted on one of said sides of said housing, the other of said light sources being mounted to the other of said sides of said housing;

said voltage detector illuminating said light sources when said voltage detector detects a voltage across said first battery power source less than a predetermined voltage;

said front of said housing a communication port in electrical communication with said computer, said communication port being adapted for electrically connecting to an external computer for permitting input into said computer input data corresponding to an image of a particular user's fingerprints and handprints;

said computer having computer memory electrically connected thereto for storing said input data;

said computer having a second battery power source electrically connected to said computer memory for maintaining storage of said input data in said computer memory, said second battery power source being positioned adjacent said access panel;

a scanner being mounted to said handgrip of said weapon and in electrical communication with said computer for obtaining an image of the fingerprints and handprints of a user grasping said handgrip and sending a corresponding signal to said computer corresponding to the obtained image;

said computer comparing said corresponding signal received from said scanner with said input data, wherein said computer activating said motor to rotate said toothed wheels in said second direction to move said guard panels to said retracted position and activating and said solenoid to retract said actuator rod to pivot said trigger stop to said lowered position when said corresponding signal matches said input data;

a motion detector for detecting motion being disposed in said housing, motion detector being electrically connected to said computer, said motor and said solenoid, said motion detector having an activation switch electrically connected between said first battery power source and said computer, motor, and solenoid;

said motion detector activating said switch upon detection of motion to thereby provide energy to said computer, motor and solenoid from said first battery power source; and said motion detector deactivating said switch upon the absence of detection of motion for a predetermined elapsed amount of time.

8. A retrofittable safety system for a weapon having a handgrip and a trigger forwardly located from said handgrip, said system comprising:

a housing adapted for removably mounting on the weapon, said housing having a top, a bottom, a front, a back and a pair of sides;

said top of said housing being adapted for positioning adjacent to said weapon such that said housing is positioned in front of said handgrip;

said back of said housing having a spaced apart pair of substantially parallel elongate slots therein;

a pair of elongate guard plates, a first of said guard plates being slidably inserted into a first of said elongate slots, a second of said guard plates being slidably inserted into a second of said elongate slots;

said first and second guard plates being slidable between extended and retracted positions;

wherein extended position is characterized by said guard plates being rearwardly extended from said back of said housing for substantially covering said trigger when said housing is mounted on the weapon to prevent a user's finger from being extendable in front of said trigger and thus preventing the firing of said weapon;

wherein said guard plates are extended into said back of said housing to uncover said trigger when said guard plates are positioned in said retracted position to permit a user's finger to be positioned in front of said trigger;

a motor for moving said guard plates between said extended and retracted positions;

a computer being provided in said housing and in electrical communication with said motor;

said housing including a communication port in electrical communication with said computer, said communication port being adapted for electrically connecting to an external computer for permitting input into said computer input data corresponding to an image of a particular user's fingerprints and handprints;

a scanner mountable to said handgrip of said weapon, said scanner being in electrical communication with said computer for obtaining an image of the fingerprints and handprints of a user grasping said handgrip and sending a corresponding signal to said computer corresponding to the obtained image;

said computer comparing said corresponding signal received from said scanner with said input data, wherein said computer activating said motor to move said guard panels to said retracted position when said corresponding signal matches said input data;

a motion detector for detecting motion being disposed in said housing, motion detector being electrically connected to said computer, said motion detector having an activation switching electrically connected to said computer said motion detector activating said switch to activate said computer upon detection of motion of said housing by said motion detector.

* * * * *